United States Patent [19]

Mochizuki et al.

[11] Patent Number: 4,639,410

[45] Date of Patent: Jan. 27, 1987

[54] SILVER HALIDE COLOR PHOTOGRAPHIC LIGHT SENSITIVE-MATERIAL

[75] Inventors: Yoshihara Mochizuki, Hachioji; Sohei Goto, Hino; Toshihiko Yagi, Kanagawa; Katsumasa Yamazaki, Hachioji; Kenji Michiue, Hino, all of Japan

[73] Assignee: Konishiroku Photo Industry Co., Ltd., Japan

[21] Appl. No.: 697,458

[22] Filed: Feb. 1, 1985

[30] Foreign Application Priority Data

Feb. 2, 1984 [JP] Japan ..... 59-17955

[51] Int. Cl.[4] ..... G03C 1/76

[52] U.S. Cl. ..... 430/506; 430/567; 430/509

[58] Field of Search ..... 430/506, 567, 509

[56] References Cited

U.S. PATENT DOCUMENTS

| | | | |
|---|---|---|---|
| 4,388,401 | 6/1983 | Hasebe et al. | 430/506 |
| 4,444,877 | 4/1984 | Koitabashi et al. | 430/567 |
| 4,446,228 | 5/1984 | Honda et al. | 430/567 |
| 4,477,564 | 10/1984 | Cellone et al. | 430/567 |
| 4,481,288 | 11/1984 | Yamada et al. | 430/506 |

FOREIGN PATENT DOCUMENTS

| | | | |
|---|---|---|---|
| 58-4332 | 1/1983 | Japan | 430/506 |
| 58-14829 | 1/1983 | Japan | 430/506 |

*Primary Examiner*—Won H. Louie

*Attorney, Agent, or Firm*—Finnegan, Henderson, Farabow, Garrett & Dunner

[57] ABSTRACT

A silver halide color photographic light-sensitive material comprises a support and at least one light-sensitive layer. This layer has a plurality of silver halide emulsion layers substantially identical in color sensitivity, but differing in speed. The light-sensitive layer is comprised substantially of monodispersed silver halide emulsions A and B, each containing silver halide particles of the core/shell-type. The silver halide particle sizes of emulsions B and A have a ratio, when multiplied by 100, of less than 70 and the silver halide particles of emulsion B have a silver iodide content in their core that is not less than 5 mole % smaller than that of the core of the silver halide particles of emulsion A.

17 Claims, No Drawings

SILVER HALIDE COLOR PHOTOGRAPHIC LIGHT SENSITIVE-MATERIAL

BACKGROUND OF THE INVENTION

1. Field of the Invention

The present invention relates to a silver halide color photographic light-sensitive material, and more particularly to a silver halide color photographic light-sensitive material improved on the photographic characteristics thereof; improved so as to have a high speed, excellent graininess in lower density areas of the image formed thereon, and wide exposure latitude.

2. Description of the Prior Art

In relation to the silver halide color photographic light-sensitive material (hereinafter referred to as the light-sensitive material), improvements on various characteristics have heretofore been demanded. Especially, the development of techniques for the light-sensitive material to increase its speed as well as to further improve its image quality (particularly in its graininess) because of the necessity to reduce the size of images to be recorded on the light-sensitive material, with the recent tendency toward miniaturization of camera sizes, has been in very strong demand in recent years. It is well-known that those methods using a monodisperse emulsion, as disclosed in Japanese Patent Publication Open to Public Inspection (hereinafter referred to as Japanese Patent O.P.I. Publication) Nos. 28743/1983, 14829/1983 and 100847/1983, are the most effective techniques for improving the graininess. Such the methods, however, are disadvantageous in respect that they do not allow adequately wide exposure latitude to be ob- tained.

On the other hand, for improving the exposure latitude, (1) a light-sensitive material composition in which the blue, green and red-sensitive silver halide emulsion layers each is comprised of a plurality of layers, e.g., two or three layers differing in the speed, (2) a composition in which silver halide emulsion layers each contains at least two different monodisperse silver halide particles differing in the mean particle size, and (3) the use in silver halide emulsion layers of several different monodisperse silver halide particles differing in the surface iodine composition according to the mean particle size, as disclosed in Japanese Patent Examined Publication No.4332/1983, are known. These methods, although they certainly improve the exposure latitude, cannot necessarily improve the graininess adequately because of the reciprocal relation between the exposure latitude and the graininess. Particularly, the improvement on the graininess in the minimum density range (fog+0.4 to fog+0.7) of the light-sensitive material, which determines the image quality, is so unsatisfactory that the graininess becomes conspicuous in a photographic print image when reproduced from the light-sensitive material.

OBJECT OF THE INVENTION

It is an object of the present invention to provide a silver halide color photographic light-sensitive material having a high speed, excellent graininess in low-density areas of an image, i.e., in the density range of from fog+0.4 to fog+0.7 in the photographic characteristic curve, and improved exposure latitude.

SUMMARY OF THE INVENTION

It has now been found that the above object is accomplished by a light-sensitive material comprising a support having thereon at least one light-sensitive layer comprised of a plurality of silver halide emulsion layers which are substantially identical in the color sensitivity but differ in the speed, the light-sensitive layer containing the following Emulsions A and B in combination, both being substantially monodisperse silver halide emulsions, wherein Emulsion A is a core/shell-type silver halide emulsion, with a mean particle size of $x\mu$, composed of a core containing not less than 6 mole % silver iodide and a shell consisting substantially of silver bromide, and Emulsion B is a core/shell-type silver halide emulsion, with a mean particle size of $y\mu$, composed of a core containing silver iodide whose content thereof is not less than 5 mole % smaller than that of the core of the above Emulsion A and a shell consisting substantially of silver bromide, wherein the x and y have a relation of $(y/x)\times 100<70$.

DETAILED DESCRIPTION OF THE INVENTION

The present invention is illustrated in detail below:

The light-sensitive material of this invention, as has been described above, is one having on its support at least one light-sensitive layer composed of a plurality of silver halide emulsion layers substantially identical in the color sensitivity but differing in the speed.

The words "substantially identical in the color sensitivity," used in above, implies that, in the width of the color sensitivity of each of the blue-, green- and red-sensitive layers, which are sensitive to blue, green and red lights, respectively, in the ordinary color photographic process, even when the color sensitivity regions of the component emulsion layers constituting each sensitive layer differ slightly, the emulsion layers can be regarded as substantially the same in the color sensitivity.

The light-sensitive material of the present invention is one having on its support at least one light-sensitive layer composed of a plurality of silver halide emulsion layers substantially identical in the color sensitivity but differing in the speed, and if, in a layer composition, this condition is met, the composition includes the layer composition commonly used in multi-layer light-sensitive materials. And the light-sensitive layers of the light-sensitive material of this invention are provided in the coating order of the red-sensitive layer, green-sensitive layer and blue-sensitive layer from the support side. Although a different coating order is allowable, the preferred is the above order, and various interlayers may be provided in between the above sensitive layers and/or between the above plurality of silver halide emulsion layers of the sensitive layers.

If the light-sensitive layers each is composed of a plurality of emulsion layers differing in the speed, as above mentioned, the plurality of silver halide emulsion layers are desirable to be located so that the furthest layer from the support side be the highest-speed layer, and the speed then become less in order toward the support side.

In the light-sensitive material of this invention, the foregoing Emulsions A and B may be incorporated in an arbitrary combination into an optional one of the plurality of silver halide emulsion layers of each of the light-sensitive layers.

The combined use of Emulsions A and B is as described in above. Above all, Emulsion A, if the silver iodide content of the core thereof is in the range of from 6 mole % to 30 mole %, can be preferredly usable. The silver iodide content of the core of Emulsion B should be not less than 5 mole % smaller than that of the core of Emulsion A; that is, the difference in the silver iodide content between Emulsion A and Emulsion B should be not less than 5 mole %, and Emulsion B, when the difference is in the range of from 5 mole % to 15 mole %, can be preferredly usable.

The shell of each of Emulsions A and B consists substantially of silver bromide, but may be allowed to contain silver iodide, silver chloride, silver iodochloride, etc., if not more than 1 mole %.

The core of each of Emulsions A and B, although desirable to be silver iodobromide, may be allowed to contain a silver halide other than silver iodobromide, such as silver chloride, as long as it does not impair the effect of this invention.

The average silver iodide content of the silver halide particles of Emulsion A is from 2 mole % to 35 mole %, and preferably from 3 mole % to 30 mole %.

The average silver iodide content of the silver halide particles of Emulsion B is from zero to 20 mole %, and preferably from zero to 15 mole %.

Further, the difference in the average silver iodide content between Emulsions A and B is from 3 mole % to 30 mole %, and preferably from 3 mole % to 15 mole %.

The thickness of the shell of each of Emulsions A and B, if expressed as the proportion by volume of the shell to the whole particle, is from 50% to 10%, and preferably from 30% to 10%.

The mean particle size of Emulsion A is desirable to be less than 70% of that of Emulsion B, and the respective mean particle sizes of Emulsion A and Emulsion B are desirable to be from about 0.4μ to about 2.0μ and from about 0.1μto 1.4μ, respectively.

The above-mentioned Emulsions A and B of the present invention are to be contained in combination in the foregoing light-sensitive layer. If the light-sensitive layer is comprised of two layers provided in the order of a low-speed silver halide emulsion layer (hereinafter merely called low-speed emulsion layer) and a high-speed silver halide emulsion layer (hereinafter merely called high-speed emulsion layer) from the support side, the Emulsions A and B are desirable to be contained in combination in the single low-speed emulsion layer, and the combination that Emulsion A is contained in the high-speed emulsion layer and Emulsion B in the low-speed emulsion layer is also desirable.

The light-sensitive layer is also desirable to be of the three-layer composition that a low-speed emulsion layer, a medium-speed emulsion layer and a high-speed emulsion layer are provided in the described order from the support side. In this instance, the preferred combination of Emulsions A and B is such that Emulsion B is contained in the low-speed emulsion layer and Emulsion A in the medium-speed emulsion layer.

In addition, a non-light-sensitive interlayer as previously mentioned may be provided in between the medium-speed emulsion layer and the low-speed emulsion layer. Further, a photographic coupler may be incorporated into the non-light-sensitive interlayer.

The effect of the present invention may be furthered by the above embodiment.

The effect of the invention may become still further conspicuous when the Emulsions A and B contained in combination in the light-sensitive layer meet the following requirements: (1) the silver iodide content of the core of Emulsion A is not less than 13 mole %, (2) that of the core of Emulsion B is less than 6 mole %, and (3) the difference in the silver iodide content between the core of Emulsion A and the core of Emulsion B is not less than 10 mole %.

Furthermore, when Emulsions A and B are to be contained in a certain speed-having silver halide emulsion layer of the plurality of silver halide emulsion layers, different in the speed, of the light-sensitive layer, it is desirable that the silver iodide content of the core of Emulsion A is from 8 mole % to 13 mole %, and the silver iodide content of the core of Emulsion B is not less than 5 mole % smaller than that of the core of the Emulsion A and is less than 5 mole %. By taking this embodiment the effect of this invention can be still more effectively displayed.

In this invention, the foregoing light-sensitive layer is allowed to be one having any color sensitivity, preferably at least a green-sensitive layer, more preferably comprises green-sensitive and red-sensitive, and most preferably green-sensitive, red-sensitive and blue-sensitive layers.

The light-sensitive layer of this invention, as aforementioned, contains Emulsions A and B in combination, but may also contain other polydisperse and/or monodisperse emulsions.

Emulsions A and B of this invention are substantially monodisperse emulsions. The terms "substantially monodisperse emulsion" used herein implies that the variance of the silver halide particle sizes has a granularity distribution of not greater than a certain proportion to the mean particle size, as shown below. The granularity distribution of an emulsion comprising a group of light-sensitive silver halide particles, the configurations of which are nearly uniform and the variance of the sizes of which is small (the emulsion is hereinafter called monodisperse emulsion), forms a normal distribution, so that the standard deviation thereof can be easily obtained. When the width of the distribution is defined by the formula:

$$\frac{\text{Standard deviation}}{\text{Mean particle size}} \times 100 = \text{Width of distribution},$$

the width of each of the distributions of Emulsions A and B of this invention is not more than 20%, and preferably not more than 15%.

The mean particle size of Emulsion B, as previously mentioned, is less than 70% of that of Emulsion A, and the more preferred mean particle size proportion (Q) ($Q=y/x$) is in the range of $30 \leqq Q < 70$.

The mixing ratio of Emulsions A and B used in this invention is such that, when Emulsion B is regarded as 1, Emulsion A is from 0.1 to 10.0 by weight of silver halide, and preferably from 0.5 to 4.

In the present invention, in addition to both Emulsions A and B, a different emulsion, containing silver halide particles having any arbitrary mean particle size, halide composition and particle size distribution, may be used inside the same light-sensitive layer, and the silver halide emulsion is to be used in a quantity not impairing the effect of this invention; accounting for 50% of the whole silver halide molarity of the silver halide emulsion in the light-sensitive layer, and more preferably not more than 30%.

For the mixing of Emulsion A with Emulsion B of the present invention, the respective particles of these emulsions obtained after completion of their first ripening (physical ripening) may be mixed, but they should be mixed preferably as sensitized particles after completion of the second ripening (chemical ripening). In practice, they may be mixed immediately after completion of the second ripening, or the ripened emulsions, after being set separately, may be mixed.

The silver halide particle crystal form for Emulsions A and B, as long as they are of monodisperse particles, can be any of hexahedral, octahedral and tetradecahedral crystals or of other crystal habit-having crystals. Particularly, the octahedral and tetradecahedral crystal forms are preferred.

The preparation of the silver halide emulsion of this invention will then be described below:

The silver halide particles of the silver halide emulsion used in this invention may be those prepared by any of the acidic, neutral or ammoniacal method, and may also be those prepared in the manner that seed particles are produced by the acidic method and then grown up to a certain particle size by the ammoniacal method, which is capable of growing the particles fast. The growth of the silver halide particles is desirable to be made in the manner that, with the pH, pAg, etc., controlled inside the reactor, silver ions and halide ions are sequentially, simultaneously poured to be mixed in quantities meeting the growth rate of the silver halide particles, as disclosed in Japanese Patent O.P.I. Publication No. 48521/1979.

For example, a book entitled "Shashin-Kogaku no Kiso (Fundamentals of Photographic Engineering)" (published in 1979 by Corona Publishing Co., Ltd.) describes in its page 158 general items relating to the above matter. For more details, Belgian Pat. No.636,801 discloses a method for obtaining composite silver halide particles having a very narrow particle size distribution; for the preparation of the so-called built-up-type emulsion, which is such that, when to the seed particles formed in advance so that the number thereof becomes maximum is added the remaining reaction components, in order to cause no increase nor decrease in the number of the particles, the remaining reaction components, i.e., the soluble silver salt and soluble halide, in adding quantities meeting the growth rate of the particles, are added simultaneously to the seed particles so that the silver ion concentration of the emulsion is always kept constant. Japanese Patent Examined Publication No.42738/1980, Japanese Patent O.P.I. Publication Nos. 158220/1979, 124139/1980, 142329/1980 and 30122/1981 also describe methods of obtaining a desired emulsion by the addition of the reaction components in quantities meeting the growth rate of the particles, with the silver ion concentration kept constant, in simultaneous mixing manner to similar seed particles having a narrow particle size distribution to the above case.

The monodisperse silver halide emulsion particles of the present invention can be easily obtained by any of these methods described above.

The excess of the halide or the secondarily produced or disused nitrate, salts such as of ammonia, and other compounds, which all are produced in preparing the emulsion of this invention, may be removed. The removal may be performed, using arbitrarily any of the noodle washing method commonly used in general emulsions, dialysis method, or coagulation-precipitation method.

The monodisperse silver halide emulsion particles of this invention may be made core/shell-type silver halide emulsion particles by any of those methods well-known to those skilled in the art.

In the present invention, salts such as, e.g., cadmium salts, zinc salts, lead salts, thalium salts, iridium salts, or complex salts of these salts, rhodium salts or complex salts thereof, or the like, may be present along with the silver halide emulsion of this invention in the course of its preparation.

The silver halide emulsion in this invention may be spectrally sensitized by using various dyes. The dyes usable in this invention include cyanines, merocyanines, complex cyanines and complex merocyanines (i.e., tri-, tetra-, and polynuclear cyanines and merocyanines), and polymethine dyes including oxonoles, hemioxonoles, styryls and streptocyanines.

The cyanine spectrally sensitizing dyes include those having two basic heterocyclic nuclei combined by the methine linkage, as derived from quinolinium, pyridinium, isoquinolinium, 3H-indolium, benz[e]indolium, oxazolium, oxazolinium, thiazolium, thiazolinium, selenazolium, selenazolinium, imidazolium, imidazolinium, benzoxazolinium, benzothiazolium, benzoselenazolium, benzimidazolium, napthoxazolium, naphthothiazolium, naphthoselenazolium, thiazolium, dihydronaphthothiazolium, sodium and imidazopyrazinium quaternary salts.

The merocyanine spectrally sensitizing dyes include those having acid nucleus and cyanine dye-type basic heterocyclic nucleus combined by the methine linkage, as derived from barbituric acid, 2-thiobarbituric acid, rhodanine, hydantoin, 2-thiohydantoin, 4-thiohydantoin, 2-pyrazoline-5-one, 2-isoxazoline5-one, indan-1,3-dione, cyclohexane-1,3-dione, 1,3-dioxane-4,6dione, pyrazoline-3,5-dione, pentane-2,4-dione, alkylsulfonylacetonitrile, malononitrile, isoquinoline-4-one and chroman-2,4-dione.

Those spectrally sensitizing dyes useful for sensitizing the silver halide emulsion in this invention are described in British Pat. No. 742,112, U.S. Pat. Nos. 1,846,300, 1,846,301, 1,846,302, 1,846,303, 1,846,304, 2,078,233, 2,089,729, 2,165,338, 2,213,238, 2,31,658, 2,493,747, 2,493,748, 2,526,632, 2,739,964 (U.S. Pat. No. Re. 24,292), 2,778,823, 2,917,516, 3,532,857, 3,411,916, 3,431,111, 2,295,276, 2,481,698, 2,503,776, 2,688,545, 2,704,714, 2,921,067, 2,945,763, 3,282,933, 3,397,060, 3,660,102, 3,660,103, 3,335,010, 3,352,680, 3,384,486, 3,397,981, 3,482,978, 3,623,881, 3,718,470 and 4,025,349. Examples of useful combinations of these dyes including their combinations with supersensitizing dyes are described in U.S. Pat. Nos.3,506,443 and 3,672,898. Examples of supersensitizing combinations of these spectrally sensitizing dyes with non-light-absorbing additives include those combinations with a thiocyanate used in the process of spectral sensitization as disclosed in U.S. Pat. No. 2,221,805, with bis-triazinylaminostilbene as described in U.S. Pat. No.2,933,390, with a sulfonated aromatic compound as described in U.S. Pat. No.2,937,089, with a mercapto-substituted heterocyclic compound as disclosed in U.S. Pat. No.3,457,078, with an iodide as described in British Pat. No.1,413,826, with such a compound as described in Gllman "Review of the Mechanism of Supersensitization," and with other compounds.

The addition of any of the above sensitizing dyes is allowed to be made at any point of the emulsion preparing process, such as at the time of starting, during, or after the chemical ripening (also called the second ripening) of the silver halide emulsion, or at an appropriate point of time prior to the coating of the ripened emulsion.

The addition of the sensitizing dye to the foregoing photographic emulsion may be carried out by using those conventionally proposed various methods. For example, as described in U.S. Pat. No. 3,469,987, the addition may be made in the manner that the sensitizing dye is dissolved into a volatile organic solvent, the solution is then dispersed into a hydrophilic colloid, and this dispersed liquid is incorporated into the emulsion. Further, sensitizing dyes of this invention may be dissolved separately into a same solvent to make separate solutions or into different solvents, and the solutions may be mixed prior to the addition to or may be added separately to the emulsion.

In the present invention, the preferred solvent used when adding the sensitizing dye to the silver halide photographic emulsion includes water-miscible organic solvents such as, e.g., methyl alcohol, ethyl alcohol, acetone, and the like.

The adding quantity of the sensitizing dye to the silver halide emulsion in this invention is from $1\times10^{-5}$ mole to $2.5\times10^{-2}$ mole per mole of silver halide, and preferably from $1.0\times10^{-4}$ mole to $1.0\times10^{-3}$ mole.

The sensitizing dye may also be used along with other sensitizing dyes or super sensitizers.

The silver halide emulsion of this invention may be subjected to various chemical sensitization treatments, which are commonly applied to ordinary photographic emulsions. That is, the emulsion may be chemically sensitized by using alone or in combination active gelatin; noble-metallic sensitizers such as water-soluble gold salts, water-soluble platinum salts, water-soluble palladium salts, water-soluble rhodium salts, water-soluble iridium salts, etc.; sulfur sensitizers; selenium sensitizers; reduction sensitizers such as polyamines, stannous chloride, and the like. Among these sensitizers the selenium sensitizers are desirable to be used for the chemical sensitization in this invention.

In the present invention, as the above sulfur sensitizer those of the prior art may be used, which include, e.g., thiosulfates, allylthiocarbamidothiourea, allylisothiocyanates, cystine, p-toluenethiosulfonates, rhodanine, and the like. In addition, those sulfur sensitizers may also be used which are described in U.S. Pat. Nos. 1,574,944, 2,410,689, 2,278,947, 2,728,668, 3,501,313, 3,656,955, West German Pat. No. 1,422,869, Japanese Pat. No.24937/1981, Japanese Patent O.P.I. Publication No. 45016/1980, and the like. These sulfur sensitizers should be added in a quantity sufficient for effectively increasing the speed of the emulsion. The quantity varies in a considerable range depending on various conditions such as pH, temperature, silver halide particle size, etc., but, as a standard, is desirable to be from about $10^{-7}$ mole to about $10^{-1}$ mole per mole of silver halide.

In this invention, in place of these sulfur sensitizers there may be used selenium sensitizers which include aliphatic isoselenocyanates such as allylisoselenocyanates; selenoureas, selenoketones, selenoamides, selenocarboxylic acid and its esters, selenophosphates; selenides such as diethyl selenide, diethyl diselenide, etc.; and particular examples of these sensitizers are described in U.S. Pat. Nos. 1,574,944, 1,602,592 and 1,623,499.

The adding quantity of the above sensitizers varies in a considerable range as in the case of sulfur sensitizers, and, as a mere standard, is desirable to be from about $10^{-7}$ to $10^{-3}$ mole per mole of silver halide.

In the present invention, as the gold sensitizer, the oxidation number of gold is allowed to be either positive monovalence or positive trivalence, and a large variety of gold compounds may be used, typical examples of which include chloroaurates such as potassium chloroaurate, auric trichloride, potassium auric thiocyanate, potassium iodoaurate, tetracyanoauric acid, ammonium aurothiocyanate, pyridyl trichlorogold, and the like.

The adding quantity of these gold sensitizers, although it varies depending on various conditions, is desirable to be from about $10^{-7}$ to $10^{-1}$ mole per mole of silver halide, as a standard.

The chemical sensitization of the silver halide particles in this invention may also be carried out by use of different other noble metals such as platinum, palladium, iridium, rhodium, etc., and salts of these metals, in combination with the above sensitizers.

The present invention allows the additional use of reduction sensitizers. Although no particular restrictions are put on the use of reduction sensitizers, the preferred ones include prior-art stannous chloride, thiourea dioxide, hydrazine derivatives and silane compounds.

The reduction sensitization is desirable to be made during the growing process of the silver halide particles or after completion of the sulfur and gold sensitizations.

The silver halide emulsion of this invention, at an arbitrary point of time in its preparation process, may have a silver halide solvent present along therewith. The silver halide solvent includes (a) those organic thioethers as disclosed in U.S. Pat. Nos. 3,271,157, 3,531,289, 3,574,628, Japanese Patent O.P.I. Publication Nos. 1019/1979, 158917/1979, and Japanese Patent Examined Publication No. 30571/1983, (b) those thiourea derivatives as described in Japanese Patent O.P.I. Publication Nos. 82408/1978, 77737/1980 and 29829/1980, (c) those AgX solvents having a thiocarbonyl group between the oxygen or sulfur atom and the nitrogen atom thereof as described in Japanese Patent O.P.I. Publication No. 144319/1978, (d) those imidazoles as described in Japanese Patent O.P.I. Publication No.100717/1979, (e) sulfites, (f) thiocyanates, (g) ammonia, (h) those hydroxyalkyl-substituted ethylenediamines as described in Japanese Patent O.P.I. Publication No.196228/1982, (i) those substituted mercaptotetrazoles as described in Japanese Patent 0.P.I. Publication No.202531/1982, and (j) those substituted benzimidazoles as described in Japanese Patent O.P.I. Publication No. 54333/1983.

Into the silver halide particles of the present invention may be incorporated various compounds after completion of their chemical ripening in order to prevent the occurrence of fog during their preparing process, storage or developing process, or to stabilize their photographic characteristics. The compounds include, e.g., azoles such as benzothiazolium salts, introindazoles, nitrobenzimidazoles, chlorobenzimidazoles, bromobenzimidazoles, mercapcothiazoles, mercaptobenzimidazoles, aminotriazoles, benzotriazoles, nitrobenzotriazoles, mercaptotetrazoles (particularly 1-phenyl-5-mercaptotetrazole), etc.: mercaptopyridines;

mercaptotriazines; thioketo compounds such as oxazolinethione; antifoggants such as benzenethiosulfinic acid, benzenesulfinic acid, benzenesulfonic acid amide, hydroquinone derivatives, aminophenol derivatives, gallic acid derivatives, ascorbic acid derivatives, etc; and various known compounds as stabilizing agents. These chemicals are desirable to be added during the chemical ripening process or prior to the coating of the emulsion.

In the present invention, gelatin and hydrophilic colloids may be used as the binder for the silver halide emulsion. The gelatin includes not only gelatin but gelatin derivatives. The gelatin derivatives include gelatin-acid anhydride reaction products, gelatin-isocyanate reaction products, and gelatin-active halogen-having compound reaction products. The acid anhydride usable in the reaction with gelatin includes maleic anhydride, phthalic anhydride, benzoic anhydride, acetic anhydride, isatic anhydride, succinic anhydride, and the like. The isocyanate compound includes, e.g., phenyl isocyanate, p-bromophenyl isocyanate, p-chlorophenyl isocyanate, p-tolyl isocyanate, p-nitrophenyl isocyanate, naththyl isocyanate, and the like.

Further, the active halogen atom-having compound includes benzenesulfonyl chloride, p-methoxybenzenesulfonyl chloride, p-phenoxybenzenesulfonyl chloride, p-bromobenzenesulfonyl chlorlde, p-toluenesulfonyl chloride, m-nitrobenzenesulfonyl chloride, m-sulfobenzoyl dichloride, naphthalene- -sulfonyl chloride, p-chlorobenzenesulfonyl chloride, 3-nitro-4-aminobenzenesulfonyl chloride, 2-carboxy-4-bromobenzenesulfonyl chloride, m-carboxybenzenesulfonyl chloride, 2-amino-5-methylbenzenesulfonyl chloride, phthalyl chloride, p-nitrobenzoyl chloride, benzoyl chloride, ethyl chlorocarbonate, furoyl chloride, and the like.

As the hydrophilic colloid for use in preparing the silver halide emulsion, in addition to the foregoing gelatin derivatives and ordinary photographic gelatin, the following materials may, if necessary, be used: colloidal albumin, agar-agar, gum arabic, dextran, alginic acid, cellulose derivatives such as the cellulose acetate hydrolyzed up to an acetyl content of from 19 to 26%, polyacrylamides, imidated polyacrylamides, casein; urethanecarboxylic acid group- or cyanoacetyl group-having vinyl alcohol polymers such as vinyl alcohol-vinyl cyanoacetate copolymer; polyvinyl-polyvinyl pyrolidone, hydrolyzed polyvinyl acetate; those polymers obtained by the polymerization of proteins or saturated acylated proteins with vinyl group-having monomers; polyvinyl pyridines, polyvinylamines, polyaminoethyl methacrylate, polyethylene imine, and the like.

The silver halide emulsion of this invention may contain various known surface active agents for various purposes such as coating aid, prevention of static electricity, improvement of smoothness, emulsification-dispersion, prevention of adherence, improvement of photographic characteristics (for, e.g., development acceleration, increasing contrast and speed), and the like.

As the surface active agents those as described in U.S. Pat. Nos. 2,240,472, 2,831,766, 3,158,484, 3,210,191, 3,294,540, 3,507,660, British Pat. Nos. 1,012,495, 1,022,878, 1,179,290, 1,198,450, U.S. Pat. Nos. 2,739,891, 2,823,123, 1,179,290, 1,198,450, 2,739,891, 2,823,123, 3,068,101, 3,415,649, 3,666,478, 3,756,828, British Pat. Nos. 1,397,218, 3,113,816, 3,411,413, 3,473,174, 3,345,974, 3,726,683, 3,843,368, Belgian Pat. No.731,126, British Pat. Nos. 1,138,514, 1,159,825, 1,374,780, U.S. Pat. Nos. 2,271,623, 2,288,226, 2,944,900, 3,235,919, 3,671,247, 3,772,021, 3,589,906, 3,666,478, 3,754,924, West German OLS Pat. No. 1,961,683; and Japanese Patent O.P.I. Publication Nos. 117414/1975, 59025/1975, Japanese Patent Examined Publication Nos. 378/1965, 379/1965 and 13822/1968, may be used, which include nonionic surface active agents including saponin (steroid type), alkylene oxide derivatives such as polyethylene glycol, polyethylene glycol/polypropylene glycol condensate, polyethylene glycol alkyl or alkyl-aryl ether polyethylene glycol esters, polyethylene glycol sorbitan esters, polyalkylene glycol alkylamines or amides, polyethylene oxide adducts of silicone, and the like, glycidol derivatives such as alkenyl-succinic acid polyglyceride, alkyl-phenol polyglyceride, etc., aliphatic acid esters of polyhydric alcohols, alkyl esters of sugar, urethanes or ethers of sugar, and the like; anionic surface active agents including those containing such acid groups as carboxy group, sulfo group, phospho group, sulfate group, phosphate group, etc., such as triterpenoid-type saponin, alkyl carboxylates, alkyl benzenesulfonates, alkylnaphthalene sulfonates, alkyl sulfates, alkyl phosphates, N-acyl-N-alkyl taurines, sulfosuccinates, sulfoalkylpolyoxyethylenealkyl-phenyl ethers, polyoxyethylenealkyl phosphates, and the like; amphoteric surface active agents including amino acids, aminoalkylsulfonic acids, aminoalkyl sulfates or phosphates, alkyl betaines, amineimides, amine oxides, and the like; and cationic surface active agents including alkylamines, aliphatic or aromatic quaternary ammonium salts, heterocyclic quaternary ammonium salts such as pyridium, imidazolium, etc., and aliphatic or heterocyclic ring-containing sulfonium or sulfonium salts, and the like.

The silver halide emulsion of this invention may contain those imidazoles, thioethers, selenoethers, or the like, as described in West German OLS Pat. Nos. 2,002,871, 2,445,611, 2,360,878, and British Pat. No. 1,352,196, as development accelerators, in addition to the above enumerated surface active agents.

The light-sensitive material of this invention may contain magenta, cyan and yellow color forming couplers in combination in its green-sensitive, red-sensitive and blue-sensitive layers, respectively, in usual manner with appropriate materials. These couplers may be either 4-equivalent or 2-equivalent to silver ions. The light-sensitive material may also contain color-compensation-effect-having colored couplers or development-inhibitor-releasing couplers (DIR couplers) which release development inhibitors during the developing process, and further those couplers whose coupling reaction products are colorless.

As the yellow color-forming coupler the prior-art open-chain ketomethylene-type couplers may be used. Among these couplers the benzoylacetanilide-type and pivaloylacetanilide-type compounds are advantageous. Typical examples of the usable yellow color-forming couplers are those as described in U.S. Pat. Nos. 2,875,057, 3,265,506, 3,408,194, 3,551,155, 3,582,322, 3,725,072, 3,891,445, West German Pat. No.1,547,868, West German OLS Pat. Nos. 2,213,461, 2,219,917, 2,261,361, 2,414,006 and 2,263,875.

Those usable as the magenta color-forming coupler include pyrazolone-type, pyrazolotriazole-type, indazolone-type, cyanoacetyl-type compounds, etc. Among them, the pyrazolone-type compounds are particularly advantageous. Typical examples are those as described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908, 3,891,445, West German Pat. No. 1,810,464, West German OLS Pat. Nos. 2,408,665, 2,417,945, 2,418,959, 2,424,467, and Japanese Patent Examined Publication No. 6031/1965.

Those usable as the cyan color-forming coupler include phenol-type and naphthol-type compounds, typical examples of which are those as described in U.S. Pat. Nos. 2,639,929, 2,434,272, 2,474,293, 2,521,908, 2,895,826, 3,034,892, 3,311,476, 3,458,315, 3,476,563, 3,583,971, 3,591,383, 3,767,411, West German OLS Pat. Nos. 2,414,830, 2,454,329, and Japanese Patent O.P.I. Publication No. 59838/1973.

As the colored coupler, those compounds described in U.S. Pat. Nos. 3,476,560, 2,521,908, 3,034,892, Japanese Patent Examined Publication Nos. 2016/1969, 22335/1963, 11304/1967, 32461/1969, Japanese Patent Application Nos. 98469/1974, 118029/1975, and West German OLS Pat. No. 2,418,959 may be used.

As the DIR coupler, those compounds described in U.S. Pat. Nos. 3,227,554, 3,617,291, 3,701,783, 3,790,384, 3,632,345, West German OLS Pat. Nos. 2,414,006, 2,454,301, 2,454,329, British Pat. No.953,454, and Japanese Patent Application No. 146570/1975 may be used.

Aside from these DIR couplers those compounds releasing development inhibitors during the developing process may also be incorporated into the light-sensitive material, examples of which compounds are described in U.S. Pat. Nos. 3,297,445, 3,379,529, and West German OLS Pat. No. 2,417,914. In addition, there may be used those couplers as described in Japanese Patent O.P.I. Publication Nos. 85549/1980, 94752/1982, 65134/1981, 135841/1981, 130716/1979, 133734/1981, 135841/1981, U.S. Pat. No. 4,310,618, and British Pat. No. 2,083,640; Research Disclosure Nos. 18360 (1979), 14850 (1980), 19033 (1980), 19146 (1980), 20525 (1981), and 21728 (1982).

These couplers described in above may be used either in combination of two or more of them in a same single layer or used alone in two or more different layers.

The incorporation of these couplers into the light-sensitive layer may be performed by a known method, e.g., the method described in U.S. Pat. No. 2,322,027, which is such that, for example, the coupler is dissolved into a solvent such as an alkyl phthalate (such as dibutyl phthalate, dioctyl phthalate), a phosphate (such as diphenyl phosphate, triphenyl phosphate, tricresyl phosphate, dioctyl phosphate), a citrate (such as tributylacetyl citrate), a benzoate (such as octyl benzoate), an alkylamide (such as diethyl-laurylamide), or the like; or an organic solvent whose boiling point is from about 30° to 150° C., including lower alkyl acetates such as ethyl acetate, butyl acetate, etc., ethyl propionate, secondary butyl alcohol, methyl-isobutyl ketone, $\beta$-ethoxyethyl acetate, methylcellosolve acetate, or the like, and the solution is then dispersed into a hydrophilic colloid. The above high-boiling organic solvent and low boiling organic solvent may be mixed to be used.

The coupler used, if it has an acid group such as of carboxylic acid or sulfonic acid, is to be incorporated in an aqueous alkaline solution into the hydrophilic colloid.

The adding quantity of these couplers is from $2\times10^{-8}$ mole to $5\times10^{-1}$ mole, and preferably from $1\times10^{-2}$ mole to $5\times10^{-1}$ mole per mole of silver in the light-sensitive layer.

The light-sensitive material of this invention may contain an anti-color stain agent, which includes hydroquinone derivatives, gallic acid derivatives, ascorbic acid derivatives, and the like, examples of which are described in U.S. Pat. Nos. 2,360,290, 2,336,327, 2,403,721, 2,418,613, 2,675,314, 2,701,197, 2,704,713, 2,728,659, 2,732,300, 2,735,765, Japanese Patent O.P.I. Publication Nos. 92988/1975, 92989/1975, 93928/1975, 10337/1975, and Japanese Patent Examined Publication No. 23813/1975.

Those useful as the antistatic agent include diacetyl cellulose, styrene-perfluoroalkyl-lithium maleate copolymer, alkaline salts of the reaction product of styrene-maleic anhydride copolymer with p-aminobenzene-sulfonic acid, and the like. Materials useful as the matting agent include methyl polymethacrylate, polystyrene, alkali-soluble polymers, and the like. Colloidal silicon oxide may also be used as the agent. The latex to be added for the purpose of improving the layer's physical properties include those copolymers obtained by copolymerizing acrylates or vinyl esters with monomers having other ethylene groups. The gelatin plasticizer to be used includes glycerol and glycol-type compounds. The viscosity-increasing agent includes styrene-sodium maleate copolymer, alkyl-vinyl ether-maleic acid copolymers, and the like.

Materials to be used as the support for the light-sensitive material of this invention include baryta paper, polyethylene-laminated paper, polypropylene synthetic paper, glass plates, cellulose acetate, cellulose nitrate, polyvinyl acetal, polypropylene, polyester film such as of polyethylene terephthalate, polystyrene, and the like. These support materials may be selected arbitrarily according to the purpose for which the light-sensitive material is used.

These support materials may, if necessary, be subjected to subbing treatment.

The light-sensitive material of this invention, after being exposed to light, may be processed by a known method, which is usually used in the photographic process.

The developer used in the black-and-white process is an alkaline solution containing a developing agent such as hydroxybenzenes, aminophenols, aminobenzenes, etc., and sulfite, carbonate, hydrogensulfite, bromide, iodide, etc., of an alkaline metal. The light-sensitive material may also be color-developed in the color developing process. In the reversal process, the exposed light-sensitive material is first developed in a black-and-white negative developer solution, then either exposed to white light or processed in a fogging agent-containing bath, and then color-developed in an alkaline developer solution containing a color-developing agent. No particular restrictions are put on the processing way; any processing manner may be applied. Typical examples include the process in which the light-sensitive material is color-developed, bleach-fixed, and, if necessary, washed, and then stabilized; and another process in which the light-sensitive material is color-developed, then bleached and fixed separately, and, if necessary, washed and then stabilized.

The light-sensitive material of this invention, besides being used as the ordinary color negative film for camera exposure and color photographic paper, may be used as those for various uses such as the silver-dye-bleach process, reversal process, diffusion transfer process, and the like.

The present invention will then be illustrated in detail by the following examples, but is not limited thereto.

EXAMPLES

Example 1: Preparation of Monodisperse Emulsion

A seed silver halide emulsion was prepared in advance in the manner that an aqueous silver nitrate solution and an aqueous potassium iodobromide solution were added simultaneously, with their adding time controlled, to an aqueous gelatin solution put in a reactor, with the pAg and pH inside the reactor controlled, and, after that, to this were added an aqueous Demol N (a product of Kawo Atlas) solution and an aqueous magnesium sulfate solution to effect precipitation-desalting, and then added gelatin, and the pAg and pH of the liquid were then adjusted to 7.8 and 6.0, respectively. Into a reactor containing the obtained seed silver halide particles and an aqueous gelatin solution, with the pAg and pH inside the reactor controlled, an ammoniacal silver nitrate solution and an aqueous potassium iodobromide solution were added in proportion to the surface area increasing rate of the growing particles, and when an appropriate particle size was obtained, the potassium iodobromide solution was replaced by an aqueous potassium bromide solution, and then its addition was continued. The emulsion liquid was subjected to precipitation-desalting in like manner, and to this was added gelatin, whereby an emulsion having a pAg of 7.8 and a pH of 6.0 was obtained. To this emulsion were further added sodium thiosulfate, chloroauric acid and ammonium thiocyanate, and it was subjected to chemical ripening. To this were further added 4-hydroxy-6-methyl-1,3,3a, 7-tetrazaindene and 6-nitrobenzimidazole, and then gelatin, whereby a monodisperse core/shell silver iodobromide emulsion was obtained. In the above process, the proportion of the potassium iodide to the potassium bromide was changed to thereby vary the molar percentage of silver iodide, as indicated in Table 1; the adding quantities of the ammoniacal silver nitrate and the potassium halide were changed to thereby vary the particle size; the particle size at the time of the replacement of the potassium iodobromide by the potassium bromide during the growth of the silver halide particles was changed to thereby vary the thickness of the shell, as given in Table 1; and the pAg during the reaction was changed to thereby vary the crystal havit, thus preparing monodisperse emulsion samples A, B, C, D, E, F, G, H and I.

In the table, the thickness of the shell is indicated in terms of the proportion of the thickness to the mean particle size of the monodisperse silver halide particles.

TABLE 1

| Emulsion sample | Mean particle size (um) | Width of particle size distribution (%) | AgI content of core (mole %) | Thickness of shell |
|---|---|---|---|---|
| A | 0.39 | 8 | 1 | 1/10 |
| B | 0.39 | 8 | 6 | 1/10 |
| C | 0.39 | 9 | 12 | 1/10 |
| D | 0.52 | 8 | 6 | 1/10 |
| E | 0.65 | 8 | 1 | 1/10 |
| F | 0.65 | 8 | 6 | 1/10 |
| G | 0.65 | 9 | 10 | 1/10 |
| H | 0.65 | 10 | 12 | 1/10 |
| I | 0.80 | 9 | 5 | 1/10 |

EXAMPLE 2

On a subbed transpared cellulose triacetate film support were coated in order the following layers to thereby prepare Sample A. (In all the examples described hereinafter, every adding quantity to the light-sensitive material is given as the weight per $m^2$ except that those of the silver halide emulsion and colloidal silver are shown as silver equivalent.)

Preparation of Sample A:

Layer 1 . . . Antihalation layer containing 0.4 g of black colloidal silver and 3 g of gelatin.

Layer 2 . . . Layer containing 0.8 g of a low-speed green-sensitive silver iodobromide emulsion (the emulsion obtained by rendering the emulsion Sample A in Table 1 green-sensitive):

A low-speed green-sensitive emulsion layer containing 2.2 g of gelatin and 0.95 g of trecresyl phosphate, into which are dissolved 0.8 g of 1-(2,4,6-trichlorophenyl)-3-[3-(2,4-di-t-amylphenoxyacetamido)benzamido]-5-pyrazolone (hereinafter called Magenta Coupler (M-1)), 0.016 g of 4-octadecylsuccinimido-2-(1-phenyl-5-tetrazolylthio)-1-indane DIR compound (hereinafter called D-1) and 0.15 g of 1-(2,4,6-trichlorophenyl)-4-(1-naphthylazo)-3-(2-chloro-5-octadecenylsuccinimidoanilino)-5-pyrazolone (hereinafter called Colored Magenta Coupler (CM-1)).

Layer 3 . . . Layer containing 1.8 g of a high-speed green-sensitive silver iodobromide emulsion (the emulsion obtained by rendering the emulsion Sample I in Table 1 green-sensitive):

A high-speed green-sensitive emulsion layer containing 1.9 g of gelatin and 0.25 g of tricresyl phosphate into which are dissolved 0.20 g of Magenta Coupler (M-1) and 0.049 g of Colored Magenta Coupler (CM-1).

Layer 4 . . . Protective layer containing 2.3 g of gelatin.

Subsequently, fourteen different samples were prepared in quite the same manner as in Sample A by varying the combination of the emulsions used in the above Layer 2 and Layer 3, and the samples were regarded as Sample 1 through 14, respectively.

TABLE 2

| Emulsion No. | High-speed green-sensitive EM layer (Layer 3) | Low-speed green-sensitive EM layer (Layer 2) |
|---|---|---|
| 1 (comparative) | Emulsion sample I | Emulsion sample F<br>Emulsiom sample B |
| 2 (comparative) | Emulsion sample I | Emulsion sample F<br>Emulsion sample C |
| 3 (comparative) | Emulsion sample I | Emulsion sample G<br>Emulsion sample B |
| 4 (comparative) | Emulsion sample I | Emulsion sample H<br>Emulsion sample D |
| 5 (invention) | Emulsion sample I | Emulsion sample H<br>Emulsion sample B |
| 6 (comparative) | Emulsion sample I | Emulsion sample E<br>Emulsion sample A |
| 7 (invention) | Emulsion sample I | Emulsion sample F<br>Emulsion sample A |
| 8 (comparative) | Emulsion sample I<br>Emulsion sample F | Emulsion sample B |
| 9 (comparative) | Emulsion sample I<br>Emulsion sample F | Emulsion sample C |
| 10 (comparative) | Emulsion sample I<br>Emulsion sample G | Emulsion sample B |
| 11 (comparative) | Emulsion sample I<br>Emulsion sample H | Emulsion sample D |
| 12 (invention) | Emulsion sample I<br>Emulsion sample H | Emulsion sample B |
| 13 (invention) | Emulsion sample I | Emulsion sample H<br>Emulsion sample A |

TABLE 2-continued

| Emulsion No. | High-speed green-sensitive EM layer (Layer 3) | Low-speed green-sensitive EM layer (Layer 2) |
|---|---|---|
| 14 (invention) | Emulsion sample I<br>Emulsion sample H | Emulsion sample A |

In table 2, the mixing ratio of the two emulsions different in the paricle size in the low-speed emulsion layer (Layer 2) is 2:1 (large-size particles:small-size particles), and the mixing ratio of the two emulsions different in the particle size in the high-speed emulsion layer (Layer 3) is 1:2 (large-size particles:small-size particles).

These 14 different samples each was exposed through an optical wedge to green light, and the processed as follows:

| Processing steps (33° C.) | Processing period |
|---|---|
| Color developing | 3 min. & 15 sec. |
| Bleaching | 6 min. & 30 sec. |
| Washing | 3 min. & 15 sec. |
| Fixing | 6 min. & 30 sec. |
| Washing | 3 min. & 15 sec. |
| Stabilizing | 1 min. & 30 sec. |

The compositions of the processing liquids used in the respective processing steps are given below:

| | |
|---|---|
| Color developer: | |
| 4-amino-3-methyl-N—ethyl-N—(β-hydroxyethyl)-aniline sulfate | 4.75 g |
| Anhydrous sodium sulfite | 4.25 g |
| Hydroxyamine ½ sulfite | 2.0 g |
| Anhydrous potassium carbonate | 37.5 g |
| Sodium bromide | 1.3 g |
| Trisodium nitriloacetate, monohydrated | 2.5 g |
| Potassium hydroxide | 1.0 g |
| Water to make 1 liter | |
| Bleaching bath: | |
| Iron-ammonium ethylenediaminetetraacetate | 100 g |
| Diammonium ethylenediaminetetraacetate | 10 g |
| Ammonium bromide | 150 g |
| Glacial acetic acid | 10 ml |
| Water to make 1 liter. Use aqueous ammonia to adjust the pH to 6.0. | |
| Fixer: | |
| Ammonium thiosulfate | 175.0 g |
| Anhydrous soldium sulfite | 8.6 g |
| Sodium metasulfite | 2.3 g |
| Water to make 1 liter. Use acetic ammonia to adjust the pH to 6.0. | |
| Stabilizing bath: | |
| Formalin (aqueous 37% solution) | 1.5 ml |
| Koniducks (manufactured by Konishi-roku Photo Ind. Co., Ltd.) | 7.5 ml |
| Water to make 1 liter | |

The color image of each sample, obtained by the above processing, was measured with use of green light with respect to the relative speed, granularity and exposure latitude. As the measure for the width of the exposure latitude, the linear exposure scale (hereinafter abbreviated to L.E.S.) was used, which is described in T. H. James "The Theory of the Photographic Process," 4th ed. P. 501 and 502. The measured results are as indicated in Table 3. In addition, the above relative speed is shown in the table with the relative value of the reciprocal of an exposure that gives a density of fog+0.1. The measurement of the above granularity was carried out by finding R.M.Ss in terms of the 1000-fold values of the standard deviations of the densities obtained when scanning the areas of fog+0.4 and of fog+0.7 with the 25μ aperture head of a SAKURA Microdensitometer, Model PDM-5, Type AR (manufactured by Konishiroku Photo Industry Co., Ltd.).

TABLE 3

| Sample No. | Relative speed | R.M.S. value fog + 0.4 | R.M.S. value fog + 0.7 | L.E.S (Δlog E) |
|---|---|---|---|---|
| 1 | 100 | 37 | 43 | 2.11 |
| 2 | 100 | 37 | 42 | 2.17 |
| 3 | 99 | 34 | 39 | 2.20 |
| 4 | 98 | 28 | 34 | 1.99 |
| 5 | 98 | 26 | 34 | 2.37 |
| 6 | 100 | 39 | 44 | 2.06 |
| 7 | 100 | 28 | 37 | 2.27 |
| 8 | 99 | 39 | 44 | 2.16 |
| 9 | 99 | 39 | 44 | 2.09 |
| 10 | 98 | 35 | 41 | 2.23 |
| 11 | 97 | 29 | 35 | 1.98 |
| 12 | 97 | 27 | 34 | 2.35 |
| 13 | 98 | 24 | 33 | 2.40 |
| 14 | 97 | 25 | 33 | 2.38 |

As is apparent from the above table, the samples of this invention (Sample Nos. 5, 7, 12, 13 and 14) are improved, without being desensitized, on the graininess in their low-density areas (fog+0.4 and fog+0.7 areas), and yet their L.E.S. values are large. On the other hand, the comparative samples (Sample Nos. 4 and 11), although improved on their graininess, have small L.E.S. values. As previously mentioned, the L.E.S. value is the measure for exposure scale; that the L.E.S. value is large means that the exposure latitude is wide.

Example 3

The following layers were coated in order on a subbed cellulose triacetate transparent film support to thereby prepare Sample B.

Layer 1 . . . The same as the Layer 1 in Example 2.

Layer 2 . . . Layer containing 1.4 g of a low-speed red-sensitive silver iodobromide emulsion (the emulsion obtained by rendering the emulsion Sample A in Table 1 red-sensitive):

A low-speed red-sensitive emulsion layer containing 1.2 g of gelatin and 0.65 g of tricresyl phosphate into which are dissolved 0.8 g of 1-hydroxy-2-[δ-(2,4-di-t-amylphenoxy)-n-butyl]naphthoamide (hereinafter called Cyan Coupler (C-1)), 0.065 g of disodium 1-hydroxy-4-[4-(1-hydroxy-δ-acetamido-3,6-disulfo-2-naphthylazo)phenoxy-N-[δ-(2,4-di-t-amylphenoxy)-butyl]-2-naphthoamide (hereinafter called Colored Cyan Coupler (CC-1), and 0.015 g of DIR Compound (D-1).

Layer 3 . . . Layer containing 1.3 g of a high-speed red-sensitive silver iodobromide emulsion (the emulsion obtained by rendering the emulsion Sample I in Table 1 red-sensitive):

A high-speed red-sensitive emulsion layer containing 1.2 g of gelatin and 0.23 g of tricresyl phosphate into which are dissolved 0.21 g of Cyan Coupler (C-1) and 0.02 g of Colored Cyan Coupler (CC-1).

Layer 4 . . . Protective layer containing 2.3 g of gelatin.

Further, Samples 15 to 26 were prepared in quite the same manner as in Sample B, obtained in above, by replacing the emulsions contained in Layer 2 and Layer 3 with those emulsion samples given in Table 4. In addition, in Table 4, the mixing ratio of the two emulsions used in the low-speed layer (Layer is 2:1 (large-size particles:small-size particles), and the mixing ratio of the two emulsions in the high-speed layer (Layer 3) is 1:2 (large-size particles:small-size particles).

TABLE 4

| Emulsion No. | High-speed red-sensitive EM layer (Layer 3) | Low-speed red-sensitive EM layer (Layer 2) |
|---|---|---|
| 15 (comparative) | Emulsion sample I | Emulsion sample F<br>Emulsion sample B |
| 16 (comparative) | Emulsion sample I | Emulsion sample F<br>Emulsion sample C |
| 17 (comparative) | Emulsion sample I | Emulsion sample G<br>Emulsion sample B |
| 18 (comparative) | Emulsion sample I | Emulsion sample H<br>Emulsion sample D |
| 19 (invention) | Emulsion sample I | Emulsion sample H<br>Emulsion sample B |
| 20 (comparative) | Emulsion sample I | Emulsion sample E<br>Emulsion sample A |
| 21 (invention) | Emulsion sample I | Emulsion sample F<br>Emulsion sample A |
| 22 (comparative) | Emulsion sample I<br>Emulsion sample F | Emulsion sample B |
| 23 (comparative) | Emulsion sample I<br>Emulsion sample F | Emulsion sample C |
| 24 (comparative) | Emulsion sample I<br>Emulsion sample G | Emulsion sample B |
| 25 (comparative) | Emulsion sample I<br>Emulsion sample H | Emulsion sample D |
| 26 (invention) | Emulsion sample I<br>Emulsion sample H | Emulsion sample B |

The obtained twelve samples each was exposed through an optical wedge to red light, and then processed in the same manner as in Example 2, whereby dye images were obtained. Each of the dye images was measured in the same manner as in Example 2 with respect to the relative speed, granularity and L.E.S. value. The obtained results are given in Table 5.

TABLE 5

| Sample No. | Relative speed | R.M.S. value fog + 0.4 | R.M.S. value fog + 0.7 | L.E.S. (Δlog E) |
|---|---|---|---|---|
| 15 | 100 | 39 | 47 | 2.15 |
| 16 | 100 | 39 | 45 | 2.20 |
| 17 | 99 | 35 | 42 | 2.22 |
| 18 | 98 | 27 | 38 | 1.94 |
| 19 | 98 | 26 | 37 | 2.38 |
| 20 | 100 | 41 | 49 | 2.11 |
| 21 | 100 | 29 | 40 | 2.29 |
| 22 | 99 | 42 | 47 | 2.13 |
| 23 | 99 | 42 | 45 | 2.15 |
| 24 | 98 | 38 | 42 | 2.22 |
| 25 | 97 | 30 | 39 | 1.92 |
| 26 | 97 | 28 | 38 | 2.36 |

As is apparent from the above table, each of the samples for the present invention (Sample Nos. 19, 21 and 26) has an effect of improving the granularity in the low-density areas (fog+0.4 and fog+0.7 areas) and also has a wide exposure scale.

Example 4

The following layers were coated in order on a subbed cellulose triacetate transparent film support to thereby prepare Sample 27.

Layer 1 . . . The Layer 1 described in Example 3.

Layer 2 . . . The Layer 2 described in Example 3.

Layer 3 . . . The Layer 3 described in Example 3.

Layer 4 . . . Interlayer containing 0.04 g of di-n-butyl phthalate (hereinafter abbreviated to DBP) into which is dissolved 0.07 g of 2,5-di-t-octylhydroquinone (hereinafter called Antistain Agent (HQ-1)),and 0.8 g of gelatin.

Layer 5 . . . The Layer 2 described in Example 2.

Layer 6 . . . The Layer 3 described in Example 2.

Layer 7 . . . Yellow filter layer containing 0.15 g of yellow colloidal silver, 0.11 of DBP into which is dissolved 0.2 g of Antistain Agent (HQ-1), and 1.5 g of gelatin.

Layer 8 . . . Layer containing 0.50 g of a low-speed blue-sensitive silver iodobromide emulsion (the emulsion Sample A given in Table 1):

A low-speed blue-sensitive emulsion layer containing 1.9 g of gelatin and 0.6 g of DBP into which are dissolved 1.5 g of α-pivaloyl-α-(1-benzyl-2-phenyl-3,5-dioxoimidazolidine-4-yl)-2'-chloro-5'-[α(dodecyloxycarbonyl)ethoxycarbonyl]acetanilide (hereinafter called Yellow Coupler (Y-1)).

Layer 9 . . . Layer containing 1.0 g of a high-speed blue-sensitive silver iodobromide emulsion (the emulsion Sample 1 given in Table 1):

A high-speed blue-sensitive emulsion layer containing 1.5 g of gelatin and 0.65 g of tricresyl phosphate into which are dissolved 1.30 g of Yellow Coupler (Y-1).

Layer 10 . . . Protective layer containing 2.3 g of gelatin.

Different other samples 28, 29, 30 and 31 were prepared in the same manner as in the above-obtained Sample 27, except that the emulsions contained in the Layers 2, 3, 5, 6, 8 and 9 of Sample 27 were replaced by those other emulsions as given in Table 6.

In addition, in Table 6, the mixing ratio of the large-size particles to the small-size particles is 2:1.

TABLE 6

| Sample No. | Blue-sensitive layer (Layer 8) | Green-sensitive layer (Layer 5) | Red-sensitive layer (layer 2) |
|---|---|---|---|
| 27 | EM sample A | EM samples F, B | EM samples F, B |
| 28 | EM samples F, C | EM samples F, C | EM samples F, C |
| 29 | EM samples G, B | EM samples G, B | EM samples G, B |
| 30 | EM samples H, D | EM samples H, D | EM samples H, D |
| 31 | EM samples H, B | EM samples H, B | EM samples H, B |

Each of the obtained Samples 27, 28, 29, 30 and 31 was exposed through an optical wedge to white light, and then processed in the same manner as in Example 2 to thereby obtain dye images. After that, in the same manner as in Example 2, the relative speed, granularity and L.E.S. value of each sample were measured. The obtained results are as given in Table 7.

TABLE 7

| Sample No. | Blue-sensitive layer: Relative speed | Blue-sensitive layer: RMS value fog + 0.4/fog + 0.7 | Blue-sensitive layer: L.E.S. (Δlog E) | Green-sensitive layer: Relative speed | Green-sensitive layer: RMS value fog + 0.4/fog + 0.7 | Green-sensitive layer: L.E.S. (Δlof E) | Red-sensitive layer: Relative speed | Red-sensitive layer: RMS value fog + 0.4/fog + 0.7 | Red-sensitive layer: L.E.S. (Δlog E) |
|---|---|---|---|---|---|---|---|---|---|
| 27 | 100 | 57/54 | 2.16 | 100 | 39/46 | 2.16 | 100 | 42/49 | 2.17 |
| 28 | 100 | 57/53 | 2.19 | 100 | 39/45 | 2.20 | 100 | 42/47 | 2.21 |
| 29 | 99 | 52/49 | 2.25 | 99 | 35/41 | 2.26 | 99 | 37/44 | 2.26 |
| 30 | 98 | 44/41 | 1.98 | 98 | 31/36 | 1.98 | 98 | 32/39 | 1.99 |

TABLE 7-continued

| Sample No. | Blue-sensitive layer Relative speed | RMS value fog + 0.4/ fog + 0.7 | L.E.S. (Δlog E) | Green-sensitive layer Relative speed | RMS value fog + 0.4/ fog + 0.7 | L.E.S. (Δlof E) | Red-sensitive layer Relative speed | RMS value fog + 0.4/ fog + 0.7 | L.E.S. (Δlog E) |
|---|---|---|---|---|---|---|---|---|---|
| 31 | 98 | 42/41 | 2.38 | 98 | 29/36 | 2.39 | 98 | 31/39 | 2.41 |

As is apparent from the above table, Sample 29 of this invention proves that improvements of the graininess and exposure latitude can be carried out, without causing desensitization, in the low-density areas (fog+0.4 and fog+0.7 areas) of each of the blue-sensitive, green-sensitive and red-sensitive layers.

EFFECT OF THE INVENTION

The present invention enables the obtaining of a silver halide color photographic light-sensitive material having excellent photographic characteristics; the sensitivity is high, the image graininess is excellent, particularly in low-density areas, and the exposure latitude is excellently wide.

What is claimed is

1. In a silver halide color photographic light-sensitive material comprising a support having thereon at least one light-sensitive layer comprised of a plurality of silver halide emulsion layers substantially identical in the color sensitivity but differing in the speed, wherein said at least one light-sensitive layer is comprised substantially of monodisperse Emulsion A and Emulsion B in combination, said Emulsion A being a core/shell-type silver halide emulsion whose silver halide particles each has a shell consisting substantially of silver bromide on the core thereof whose silver iodide content is not less than 6 mole %, said silver halide particles having a mean particle size of xμ, said Emulsion B being a core/shell-type silver halide emulsion whose silver halide particles each has a shell consisting substantially of silver bromide on the core thereof whose silver iodide content is not less than 5 mole % smaller than that of said core of said Emulsion A, said silver halide particles of Emulsion A having a mean particle size of yμ, wherein said x and said y have a relation of $(y/x)\times 100<70$.

2. The silver halide color photographic light-sensitive material of claim 1, wherein said silver iodide content of said core of said Emulsion A is from 6 mole % to 30 mole %.

3. The silver halide color photographic light-sensitive material of claim 1, wherein said silver iodide content of said core of said Emulsion B is from 5 mole % to 15 mole % smaller than that of said Emulsion A.

4. The silver halide color photographic light-sensitive material of claim 1, wherein said Emulsion A and said Emulsion B are contained in said light-sensitive layer in the following proportion: when said Emulsion B is regarded as 1, said Emulsion A is from 0.1 to 10 by weight of silver halide.

5. The silver halide color photographic light-sensitive material of claim 1, wherein said Emulsion A and said Emulsion B are contained in said light-sensitive layer in the following proportion: when said Emulsion B is regarded as 1, said Emulsion A is from 0.5 to 4 by weight of silver halide.

6. The silver halide color photographic light-sensitive material of claim 1, wherein said silver iodide content on the average of said silver halide particles of said Emulsion A is from 2 mole % to 35 mole %.

7. The silver halide color photographic light-sensitive material of claim 1, wherein said silver iodide content on the average of said silver halide particles of said Emulsion B is from zero to 20 mole %.

8. The silver halide color photographic light-sensitive material of claim 1, wherein said mean particle size of xμ is from 0.4μ to 2.0μ, and said mean particle size of yμ is from 0.1μ to 1.4μ.

9. The silver halide color photographic light-sensitive material of claim 1, wherein said silver iodide content of said core of said Emulsion A is not less than 13 mole %, and that of said Emulsion B is less than 6 mole %, and the difference in the silver iodide content between said core of said Emulsion A and that of said Emulsion B is not less than 10 mole %.

10. The silver halide color photographic light-sensitive material of claim 1, wherein said silver iodide content of said core of said Emulsion A is from 8 mole % to 13 mole %, said silver iodide content of said core of said Emulsion B is not less than 5 mole % smaller than that of said Emulsion A, and said silver iodide content of said core of said Emulsion B is less than 5 mole %.

11. The silver halide color photographic light-sensitive material of claim 1, wherein the difference between said silver iodide content on the average of said Emulsion A and that of said Emulsion B is from 3 mole % to 30 mole %.

12. The silver halide color photographic light-sensitive material of claim 1, wherein said shell of said silver halide particles of each of said Emulsion A and said Emulsion B has a thickness in terms of the volume of said shell accounting for 50% to 10% of said whole silver halide particles.

13. The silver halide color photographic light-sensitive material of claim 1, wherein said light-sensitive layer is comprised of two emulsion layers: a low-speed silver halide emulsion layer and a high-speed silver halide emulsion layer in the described order from the support side, and both said Emulsion A and said Emulsion B are contained in combination in said low-speed silver halide emulsion layer.

14. The silver halide color photographic light-sensitive material of claim 1, wherein said light-sensitive layer is comprised of two emulsion layers: a low-speed silver halide emulsion layer and a high-speed silver halide emulsion layer in the described order from the support side, and said Emulsion A is contained in said high-speed silver halide emulsion layer and said Emulsion B is contained in said low-speed silver halide emulsion layer.

15. The silver halide color photographic light-sensitive material of claim 1, wherein said light-sensitive layer is comprised of three layers: a low-speed silver halide emulsion layer, a medium-speed silver halide emulsion layer and a high-speed silver halide emulsion layer in the described order from the support side, and said Emulsion B is contained in said low-speed silver halide emulsion layer and said Emulsion A is contained in said medium-speed silver halide emulsion layer.

16. The silver halide color photographic light-sensitive material of claim 1, wherein said light-sensitive layers are red-sensitive layer, green-sensitive layer and blue-sensitive layer, said sensitive layers being provided in the order of said red-sensitive layer, said green-sensitive layer and said blue-sensitive layer from the support side.

17. The silver halide color photographic light-sensitive material of claim 1, wherein said cores of the core/-shell-type silver halide particles in emulsion A and emulsion B consist of silver iodidebromide.

* * * * *

UNITED STATES PATENT AND TRADEMARK OFFICE

CERTIFICATE OF CORRECTION

PATENT NO. : 4,639,410

DATED : January 27, 1987

INVENTOR(S) : Yoshihara Mochizuki et al.

It is certified that error appears in the above-identified patent and that said Letters Patent is hereby corrected as shown below:

Claim 1, column 19, lines 45-46, delete the hyphen ("-") at the end of line 45 so that the formula will read as "(y/x) X 100 < 70".

Signed and Sealed this

Twenty-first Day of April, 1987

*Attest:*

DONALD J. QUIGG

*Attesting Officer*

*Commissioner of Patents and Trademarks*